US006513270B1

(12) United States Patent
Mackenzie

(10) Patent No.: US 6,513,270 B1
(45) Date of Patent: Feb. 4, 2003

(54) POP-UP PICTURE CARD

(76) Inventor: Norman Fraser Mackenzie, 55 B Ferndale Road, Leytonston, London (GB), E11 3DW ( * ) Notice: Subject to any disclaimer, the term of this patent is extended or adjusted under 35 U.S.C. 154(b) by 0 days.

(21) Appl. No.: 09/647,527

(22) PCT Filed: Apr. 8, 1999

(86) PCT No.: PCT/GB99/01077

§ 371 (c)(1),
(2), (4) Date: Oct. 2, 2000

(87) PCT Pub. No.: WO99/52717

PCT Pub. Date: Oct. 21, 1999

(51) Int. Cl.[7] ..... G09F 1/06
(52) U.S. Cl. ..... 40/124.08; 40/539
(58) Field of Search ..... 40/124.08, 539

(56) References Cited

U.S. PATENT DOCUMENTS 3,191,328 A 6/1965 Lohnes
5,259,133 A * 11/1993 Burtch ..... 40/124.08
5,450,680 A * 9/1995 Bromberg ..... 40/124.08
5,492,522 A * 2/1996 Rubar ..... 493/124.08
5,611,161 A * 3/1997 Murphy

FOREIGN PATENT DOCUMENTS

DE 199310598.3 10/1993
EP 0 647 930 A1 4/1995

* cited by examiner

*Primary Examiner*—Cassandra H. Davis

(57) ABSTRACT

A picture display card (2) which may be rectangular, circular or any shape, comprising an interior sliding member (16), which is attached to the end of a display panel (24), at an extension (26), which when pulled at tab (19) from the opposite end of the device (2) raises the said panel (24) from the top-surface (23) into a vertical position, by levering the said panel (24) about a fulcrum on two projecting arms (28), cut from the top surface (23). A projecting spur (27) extending from the base of the display panel (24) engages with a slit (20), cut into the base (18), going through an aperture (17) on the sliding member (16), locking the said panel (24) into the vertical position.

15 Claims, 17 Drawing Sheets

POP-UP PICTURE CARD

The present invention relates to apparatus for displaying a picture or graphic image.

Companies are constantly seeking to produce interesting ways of presenting pictures and graphics, relating either to their products, or to promotional activities in which they are involved. Furthermore, companies are constantly looking for new ways to promote these products, and therefore there is a constant demand for inexpensive 'novelty' items which companies can give away as promotional gifts, either with or without their products.

According to the present invention, there is provided apparatus for displaying pictures or graphics, which may be on any of the surfaces of the apparatus. There may, for example, be an image on the front surface, which is visible before deployment, and there may also be additional images within the body of the apparatus, which will only become visible when the apparatus is deployed.

In the examples provided, there are TWO versions, each constructed differently, but which deploy in very similar ways. Although the examples provided here are rectangular, they may be made in almost any shape or size.

In the FIRST version, an envelope with an aperture cut into the front surface, and extending partially around the base, contains a rigid and fixed member within it. Attached to the top of this member, is another member, which is folded downwards, behind the aperture, and is made slightly smaller than the aperture. This is the member which carries the image or graphic, and before it reaches the base of the envelope, it folds backwards on itself, and returns to a point on the fixed interior member, which is slightly further up than the point at which it began it's downward direction. From there, it joins another member at a fold, and returns beneath the fixed interior member, emerging through the point in the aperture cut into the front of the envelope, where that aperture extends round towards the back of the envelope.

At this point the small member which extends from that point in the aperture, is folded upwards, towards the front of the envelope and forms a 'lip' which comes down, and extends slightly, over the bottom fold of the 'image' member: when this small 'extension-tab' is pulled therefore, as the user would to deploy the apparatus, the member which carries the image begins to rise, but is initially inhibited by means of the 'lip' which extends slightly over it's front end. If the user continues to pull on this extension however, the 'lip' will pull away from the bottom end of the image-bearing member, which will rise suddenly from the point at which it joins the rigid interior member, at the top-front of the envelope, being 'levered' upwards by means of being pulled at the point where it extends slightly over the rigid interior member. If the pulling motion is continued, the image-bearing member will continue its upward movement, until it is almost flat against the front of the envelope: however, there may be incorporated within that fold at which the image member joins the downward-sliding member, a small projection, extending along the same plane as the picture member. As the image-bearing member is raised, this small projection may engage with any aperture or cut within the back of the envelope, and below the sliding member, to stop and secure it in a position, either perpendicular to the front of the envelope, or indeed, at any angle.

A feature of this particular mechanism, is the sudden rise of the member which carries the image, which deploys immediately with a sharp, 'snap'.

The apparatus may be laid flat when the picture is deployed into a position perpendicular to the plane of the envelope, to display the image or graphic to best advantage. In order to return the apparatus to the flat or un-deployed position, the user simply pushes the member which is used to deploy the apparatus, in a reverse motion, back inside the envelope. The image member will descend, and to lock it back beneath the 'lip' on the extension member, the user will simply slip it back beneath the 'lip' with finger and thumb.

Additionally, another method of raising the image member, is by applying pressure from the top of the envelope; instead of the sliding member descending first, downwards, behind the interior fixed member, it first rises to the top of the inside of the envelope, where it is accessed by means of an aperture indented into the side of the envelope. It then folds backwards, before descending downwards to it's terminus in the extension-tab and 'lip' at the base. If pressure is applied with a finger to the new extension, through the top aperture, the lip at the base will retract, and the image member will rise into position in the same way.

In the SECOND version, the envelope itself incorporates on it's top surface, a panel cut out of that surface. Although, like the first version, it can be made in almost any shape, the present version is rectangular. The rectangular panel which is cut from the top surface, is attached on the one remaining side, by means of two 'arms' running within the width of the surface from which they continue outwards from the central, or 'image panel', towards the edge of the envelope; at the point where these two arms attach to the panel, they are hinged, enabling the panel, which may carry an image or graphic on one or both sides, to rise on those hinges. The 'arms' stop short of the edge of the top surface.

Between the two 'arms' is another panel which takes up the entire space between the two arms. This panel is also hinged, but at a point slightly further out from the hinges on the outer 'arms'. This central panel is separated from the top surface by means of it's being cut across before it reaches the edge of that top surface. It is glued to the surface below, a panel which slides between the two surfaces of the envelope, parallel with the two 'arms', the other end of which protrudes from the opposite side of the envelope, which is open, to the hinges, and which can be grasped at that end through recesses cut into both surfaces of the envelope for that purpose, at that point. This 'sliding' panel, ends in an extension which folds upwards and back onto the top surface of the envelope, providing an extension-tab and 'lip' which acts as a retaining member holding the image panel flat against the envelope prior to deployment by the user. As in the first version, the unit is deployed by the user pulling outwards on the folded extension-tab at the end of the sliding member, which is attached to the central panel between the two 'arms'. As the panel between the two 'arms' is pulled, by this action, towards the centre of the top surface, it tends to raise the image panel upwards about the outer hinges. As pulling continues, the lip releases the far edge of the image panel, and as in the case of the first version, this panel 'snaps' upwards; again, the panel will continue to 'rotate' about the fulcrum of the hinges for almost 180 degrees, until it is almost flat against the surface of the envelope, unless it is stopped in some way. This may be achieved by means of an aperture or cut in the bottom surface of the envelope. At the centre, therefore, of the folding hinges on the panel between the two 'arms', a projection is cut, continuing outwards from, and on the same plane as the image panel: it is, however, unable to reach any impediment on the base, because the sliding member is between it and the base. Therefore, immediately below this, on the sliding member, is an aperture, through which this projection or 'spur' can move freely as the image panel is raised upwards. On the bottom surface, then, is cut a slit, with which the 'spur' engages, through the aperture on the sliding member, when the panel reaches the perpendicular, or desired angle.

As in the case of the first version, the mechanism may also be operated by pressure from the other side of the envelope, by extending the sliding member, and making it accessible through an indented aperture on the opposite edge.

An embodiment of the present invention will now be described by way of example with reference to the accompanying drawings, in which:

(FIRST version)

Figure 1:
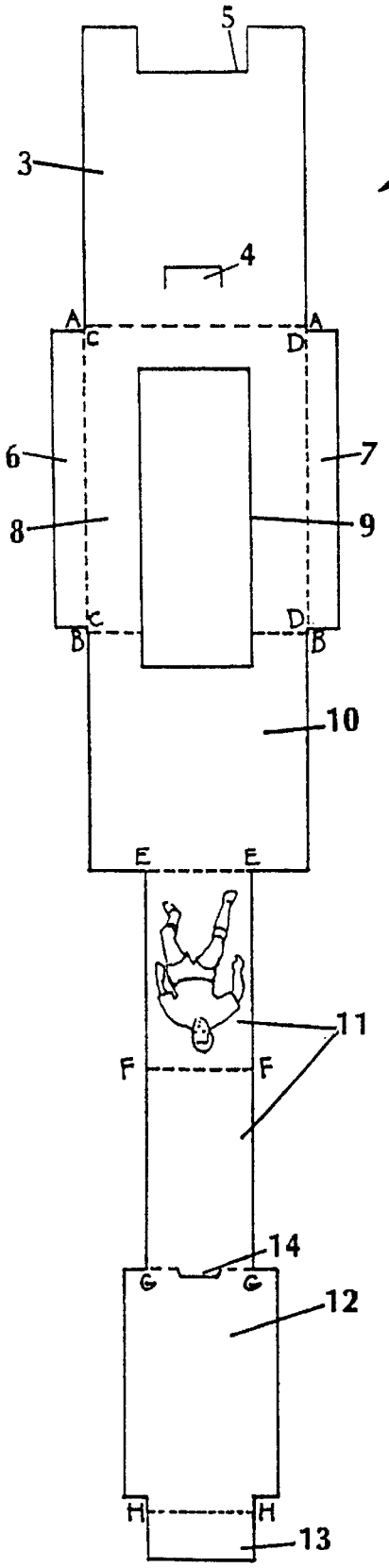
FIG. 1 is a rear, or 'internal' view of the apparatus prior to assembly.
Figure 2:
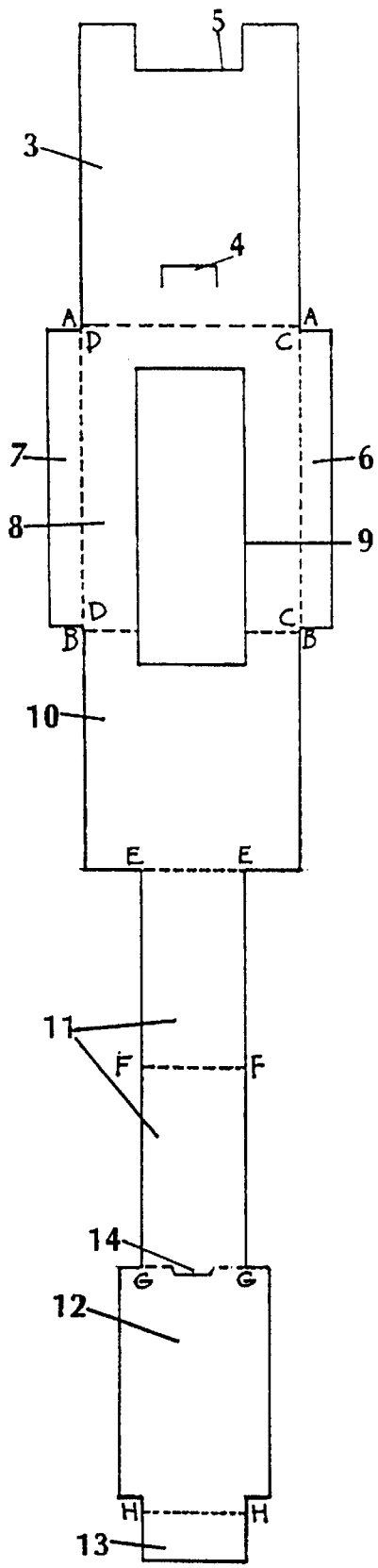
FIG. 2 is a front view of the apparatus prior to assembly.

According to FIGS. 1 and 2 the apparatus 1 consists of a single sheet of paper, card, plastic or some other suitable material. The apparatus 1 is in this case, rectangular with an aperture 9 cut into the front 8 and extending lengthways from near one end of the front surface 8 centrally, and continuing until it meets the other edge at fold line B—B. At that point, it meets the interior member 10, and continues into that member 10 for a short distance.

Figure 3:
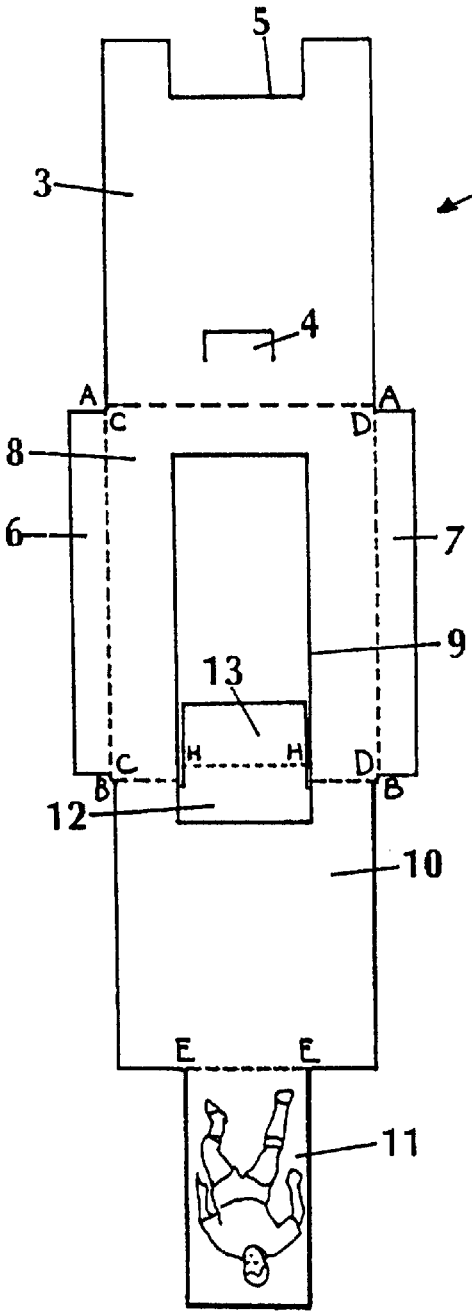
FIG. 3 is a view of the first stage of assembly, showing the two parts of the image panel being folded together.
Figure 4:
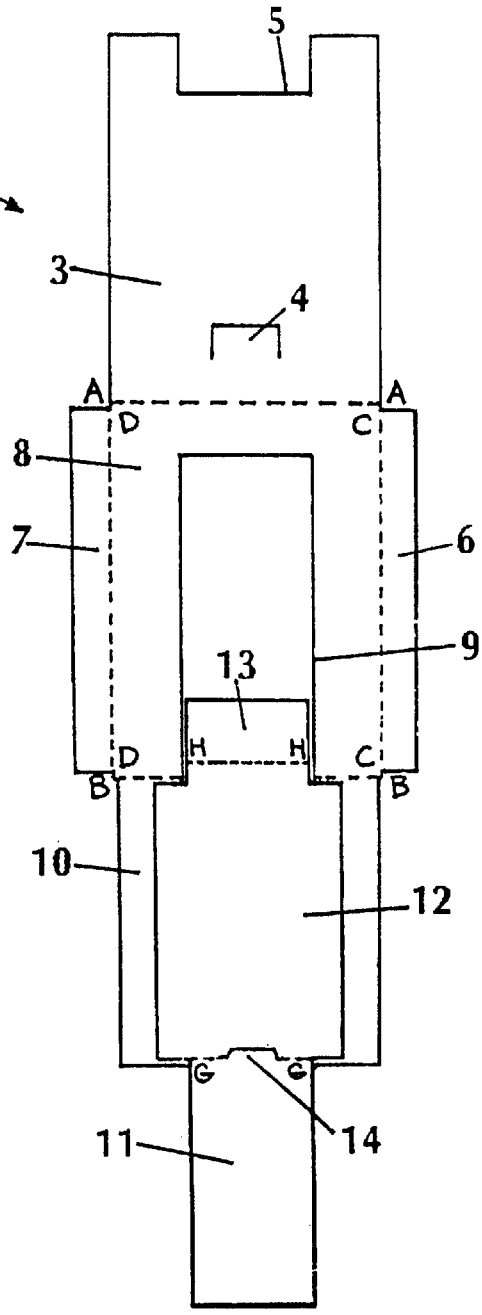
FIG. 4 shows the same from the other side.
Figure 5:
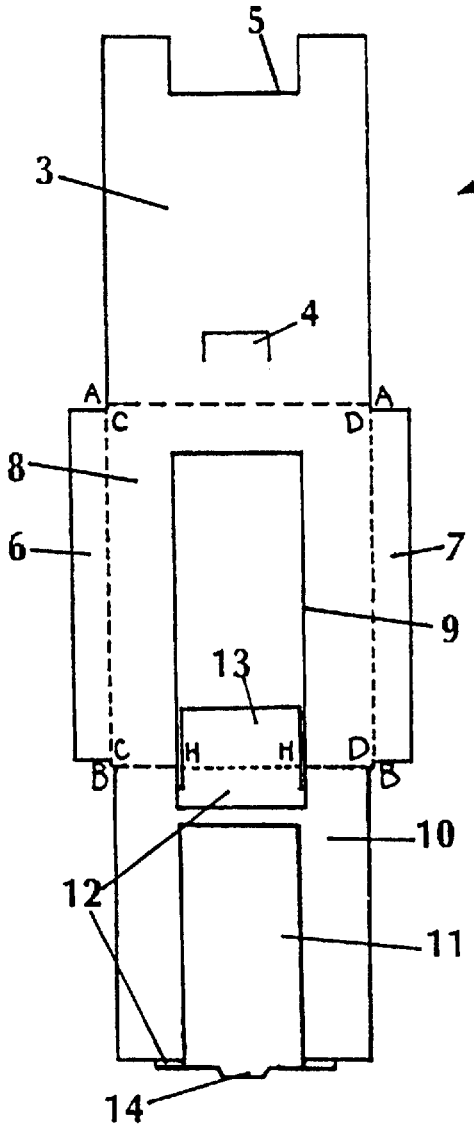
FIG. 5 shows the image panel being folded in position against the interior fixed member.
Figure 6:
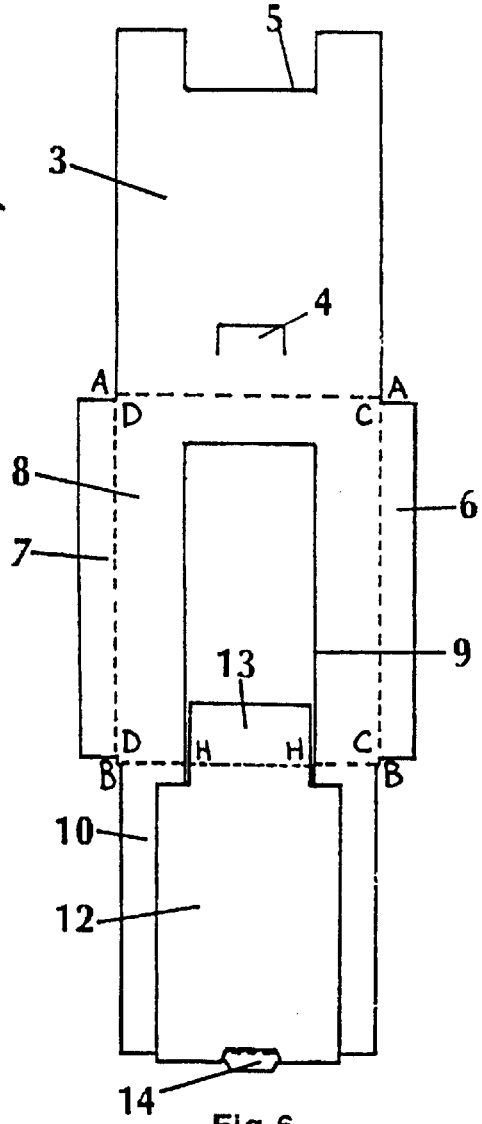
FIG. 6 shows the other side, with the sliding member folded against the other side of the interior fixed member.
Figure 7:
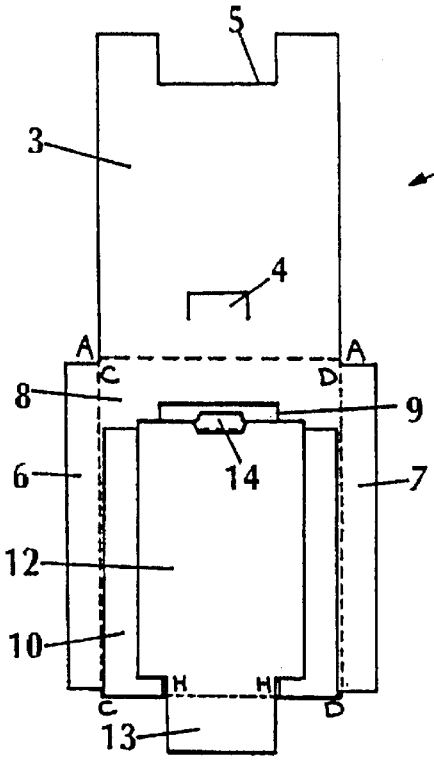
FIG. 7 is a rear view, showing the interior mechanism folded and glued into position within the envelope.
Figure 8:
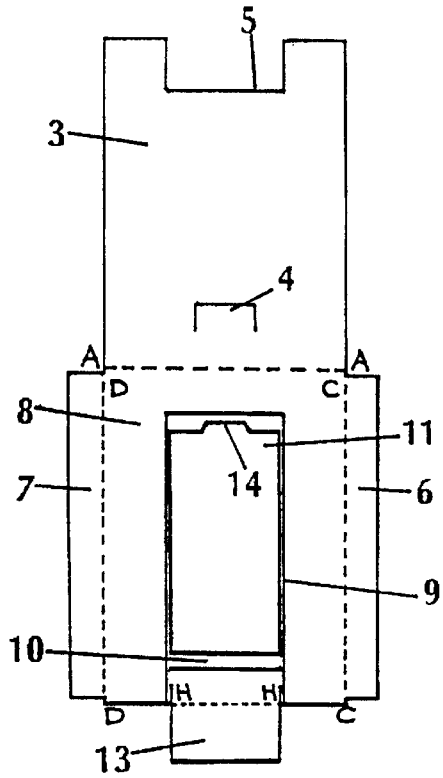
FIG. 8 is the front view of the same.

This fixed interior member 10, is joined at it's other ends at fold E—E to the narrower, image-bearing panel 11, which prior to assembly is in two parts, which meet at fold F—F, and are glued together to make a single member 11, and shown in FIGS. 3 and 4, with an extension, which is achieved by having the section 11 between fold lines F—F and G—G slightly longer than the section 11 which is between fold lines E—E and F—F. The fold line G—G therefore extends slightly further beyond fold line E—E when the two sections of the image member 11 are joined to make one member 11. On the fold line G—G at the end of the image member 11, is incorporated a small projection or 'spur' 14 which interrupts the fold G—G and continues outwards for a very short distance on the same plane as the image member 11. At the fold line G—G, the image member 11 meets another panel 12 slightly wider than the itself 11, which is a sliding panel 12, ending at fold line H—H in a small narrower extension tab 13. FIG. 5 shows how the image member 11 is folded flat against the fixed interior member 10, at fold E—E, while the sliding panel 12 is folded around the other side of the same member 10. FIGS. 7 and 8 show the next stage in the assembly with the fixed interior member 10 being folded upwards along fold line B—B, placing the image member 11 directly behind the aperture 9 cut into the top surface 8. The fixed member 10 is glued directly to the interior surface 8 on either side of the aperture 9. FIG. 8 shows how the image panel 11, slightly smaller than the aperture 9 is framed by the aperture 9. Behind the fixed member 10 is the sliding member 12 attached to the extended end of the image panel 11 at fold G—G.

Figure 9:
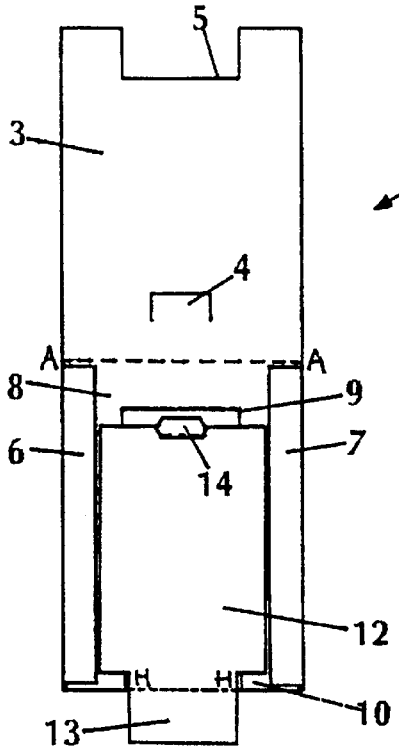
FIG. 9 is again a rear view of the interior with the side-flaps/guides folded inwards prior to sealing, with extension-tab projecting downwards.
Figure 10:
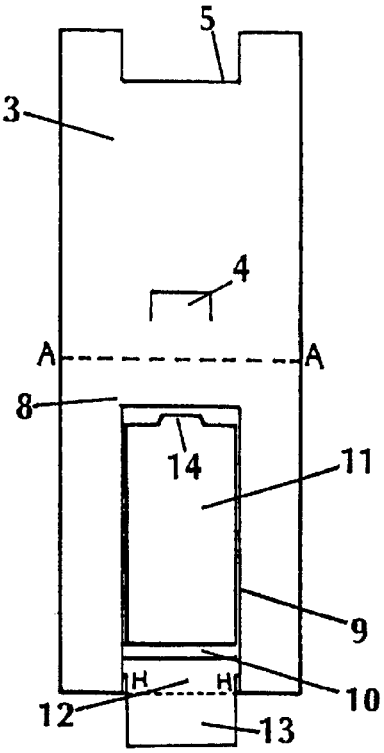
FIG. 10 is a front view of the same, showing the aperture with image panel in situ.
Figure 11:
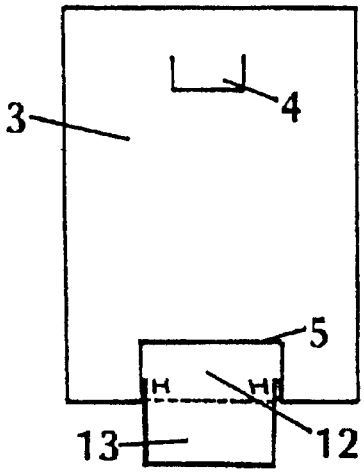
FIG. 11 is a rear view of the apparatus with the extension or 'pull' tab still unfolded.
Figure 12:
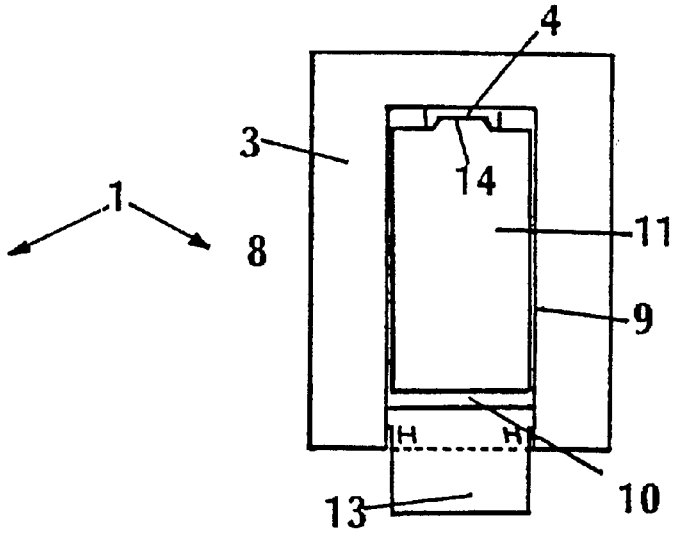
FIG. 12 is a front view of the same.
Figure 13:
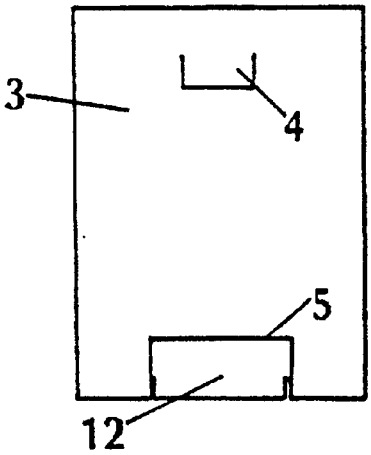
FIG. 13 is a rear view of the fully assembled apparatus.
Figure 14:
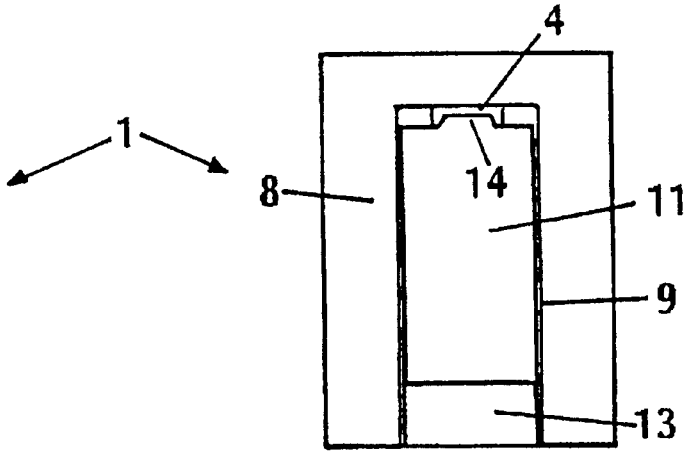
FIG. 14 is a front view of the same.

FIG. 9 shows the way in which side flaps 6, 7 are swung inwards over the interior surface 8 and overlapping the fixed member 10, and glued in situ. FIG. 10 shows the front view of this. The inside edges of those flaps 6, 7, which stop short of the edge of the sliding member 12, will act as 'rails' guiding the sliding member 12 during deployment of the apparatus 1. FIG. 11 shows how the rear panel 3, which joins the front surface 8 at fold line A—A is folded down to cover the interior containing elements 10,11,12 and 14, in position, and glued at the edges to side flaps 6 and 7 to form an envelope, 3, 8, open at one end along fold line B—B, with the extension tab 13 protruding at fold line H—H. FIG. 12 shows the front surface 8 of this stage. FIG. 13 shows the rear view of the fully assembled apparatus 1, and FIG. 14 shows the extension tab 13 folded upwards into the front surface 8 of the envelope, and retaining the tip of the image member 11. It is also worth mentioning here, that the aperture 9 may incorporate a cover-member, which may be perforated, and removed by the user on receipt of the apparatus 1.

Figure 15:
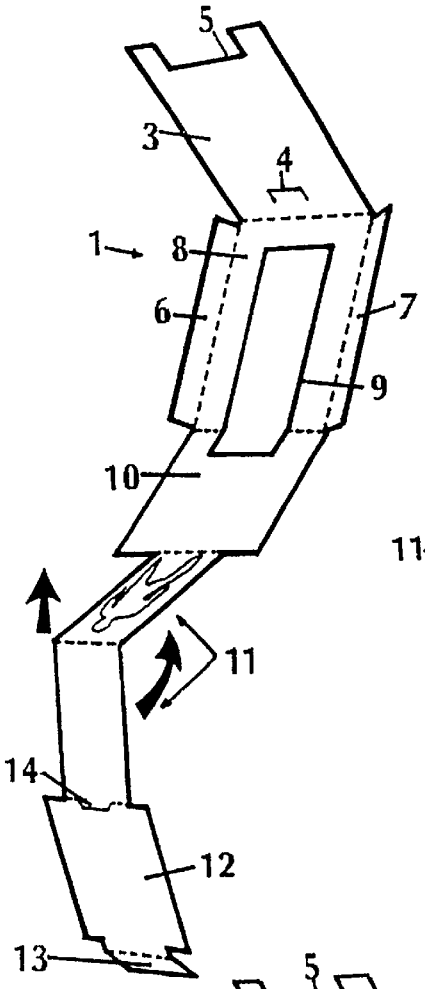
FIGS. 15–25 are three-dimensional drawings showing various stages in the assembly process, in almost similar stages.
Figure 16:
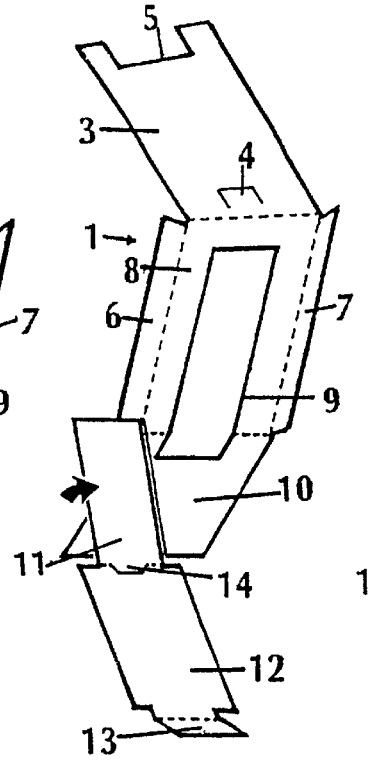
Figure 17:
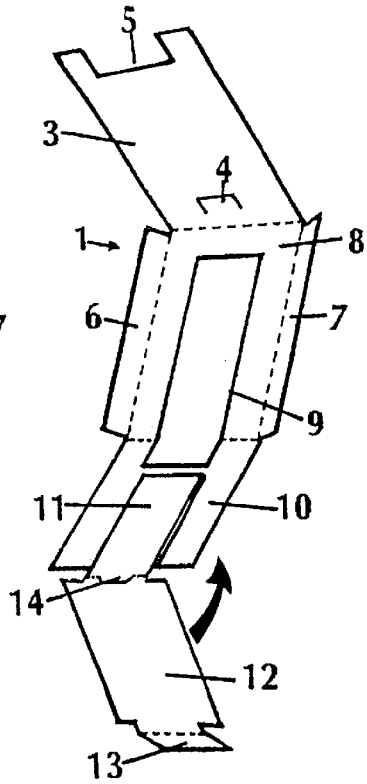
Figure 18:
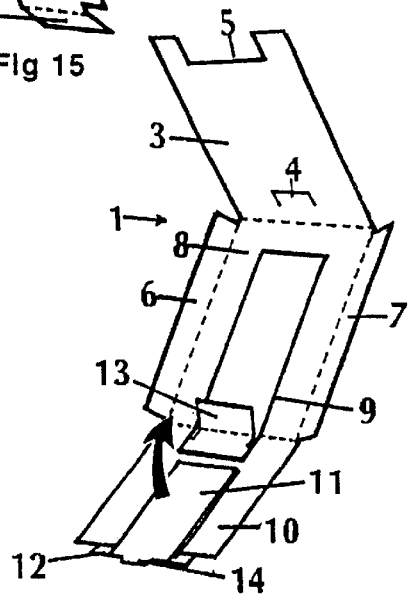
Figure 19:
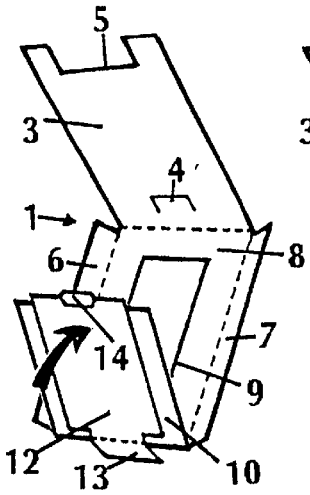
Figure 20:
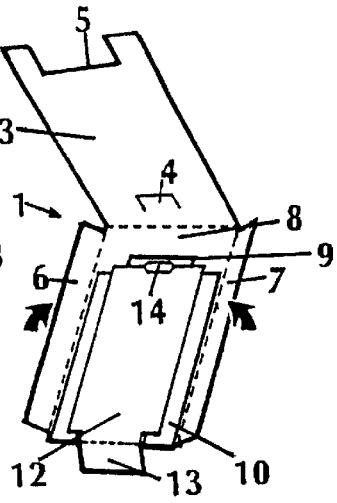
Figure 21:
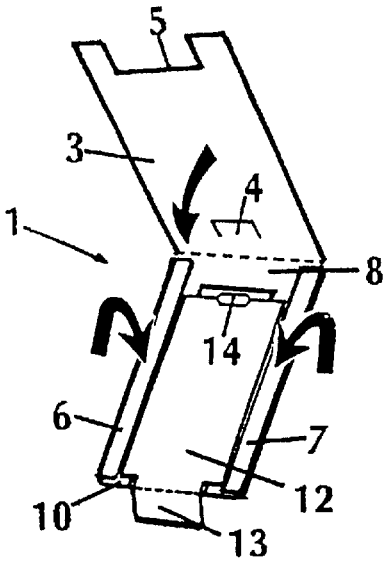
Figure 22:
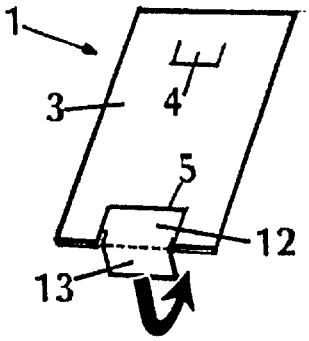
Figure 23:
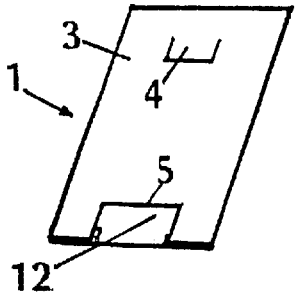
Figure 24:
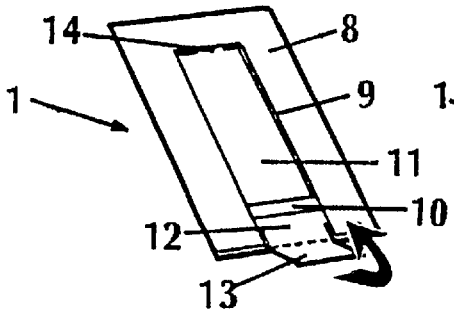
Figure 25:
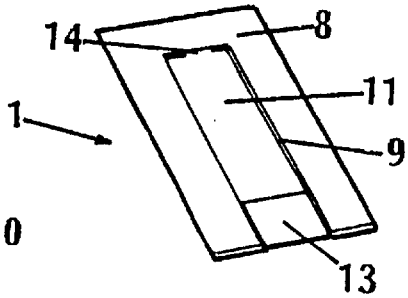

FIGS. 15 through to 25 show the assembly process in three dimensions.

Figure 26:
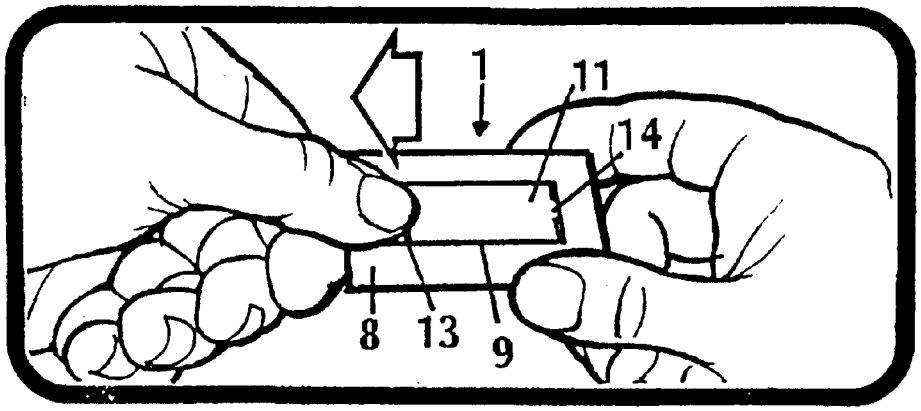
FIGS. 26–28 are schematic drawings showing how the user deploys the apparatus, and how it might look in a deployed position.
Figure 27:
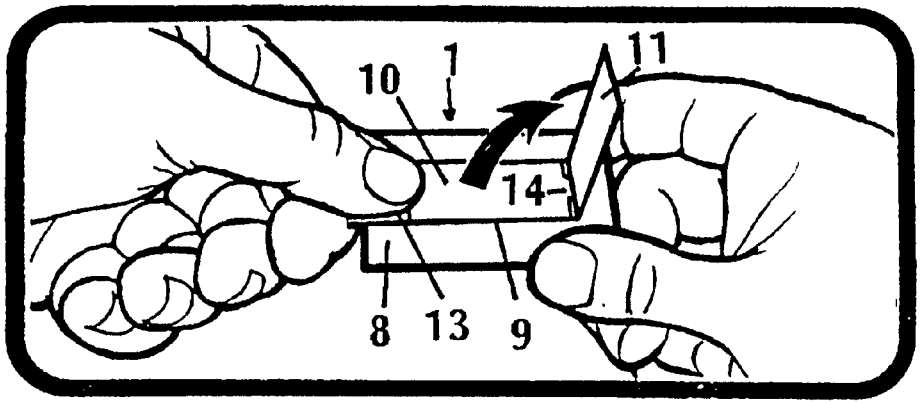
Figure 28:
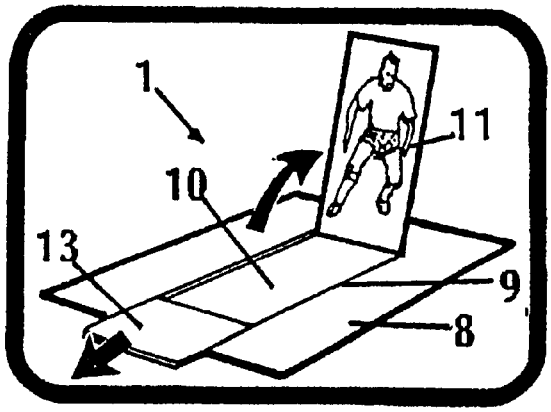

FIGS. 26–28 show how the apparatus 1 is deployed by the user; the envelope is held across the width by the finger and thumb of one hand, while the extension tab 13 is pulled outwards with the other, causing the image member 11 to rise suddenly into position, which will be perpendicular to the top surface 8 of the envelope 8,3 as the spur 14 on the fold line G—G engages with the slit 4 cut into the base panel 3. In this position, the apparatus 1 may be laid flat on it's base 3, displaying the image on either side of it's raised surface 11 to full advantage. Additional graphics, images or information may also be presented on the surface of the fixed member 10, exposed when the apparatus 1 is deployed.

Figure 29:
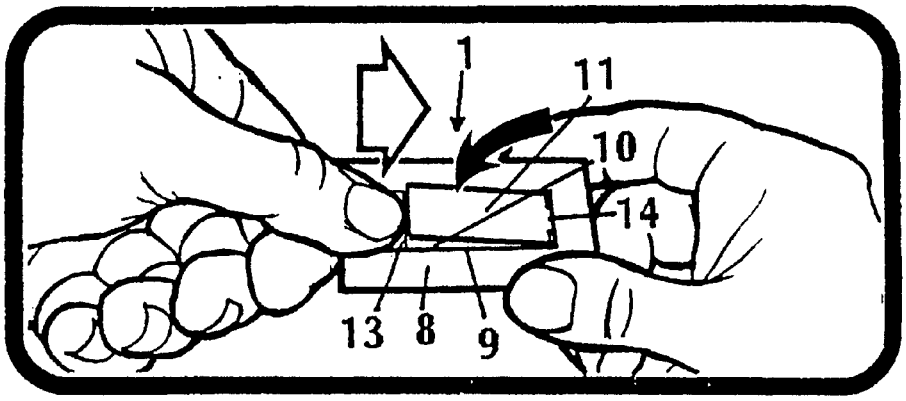
FIGS. 29–31 show how the user would return the apparatus to it's flat or un-deployed position.
Figure 30:
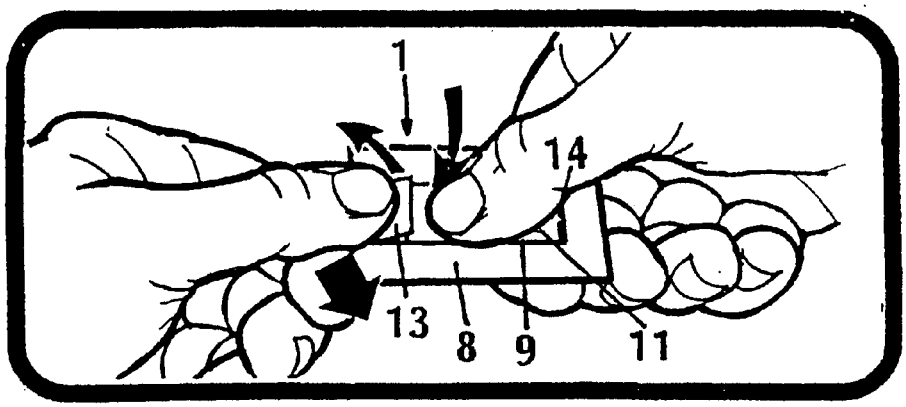
Figure 31:
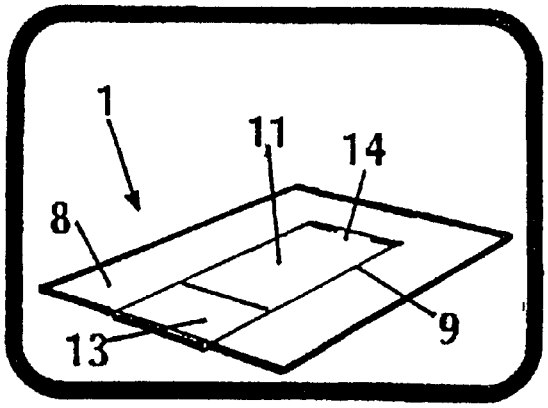

FIGS. 29–31 show how the apparatus 1 is returned to it's flat or un-deployed position. The user simply pushes the extension tab 13 back into the body of the apparatus 1, which brings the image member 11 back down, horizontal to the surface 8,10 of the apparatus. In order to lock the image member 11, back in it's original position, the user depresses the outside edge of the extension tab 13, raising the 'lip' at it's inside edge, and with finger and thumb, pushes the tip of the image member 11 back beneath it, and releases the extension tab 13, which will retain the image member 11 flush with the surface 8 against the surface of the fixed member 10, and within the recessed aperture 9 of the apparatus 1.

Figure 32:
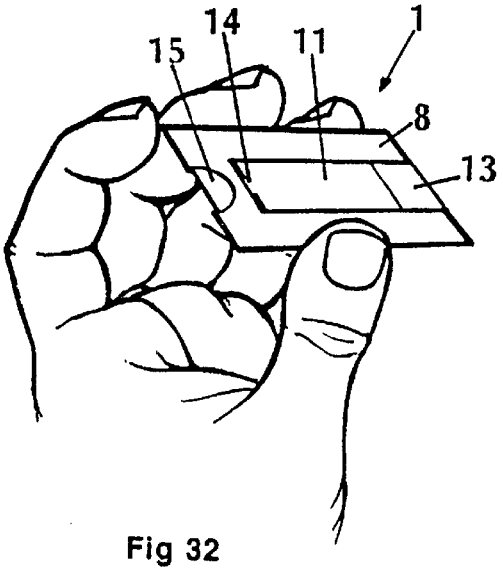
FIGS. 32 and 33 show a variant of the apparatus where the release and deploying mechanism are applied by a 'push' at the other end of the apparatus, instead of the 'pull' from the extension-tab.
Figure 33:
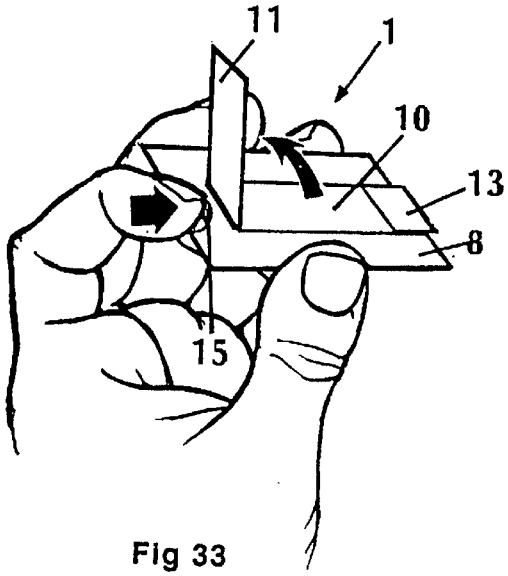

FIGS. 32 and 33 show an alternative way of releasing the image member 11. The sliding member 12, is simply extended, creating an additional folded member 15, beyond fold line G—G, into the outside edge at fold line A—A where rear surface 3 meets front surface 8, before returning and re-connecting with the image member 11 at G—G. At the centre of the edge along fold line A—A, is an aperture cut into both surfaces 3, 8 corresponding to each other, through which the new member 15 is accessible. Inward pressure, with a finger on this member 15, will push the base of the image member 11 beneath the fixed member 10, raising the image member 11 in the same way as before. Since the new member 15 is an extension of the sliding member 12, pushing on that member 15 will also cause the extension tab 13 to retract outwards, releasing the image member 11 in the same way.

(SECOND version)

Figures 34, 35:
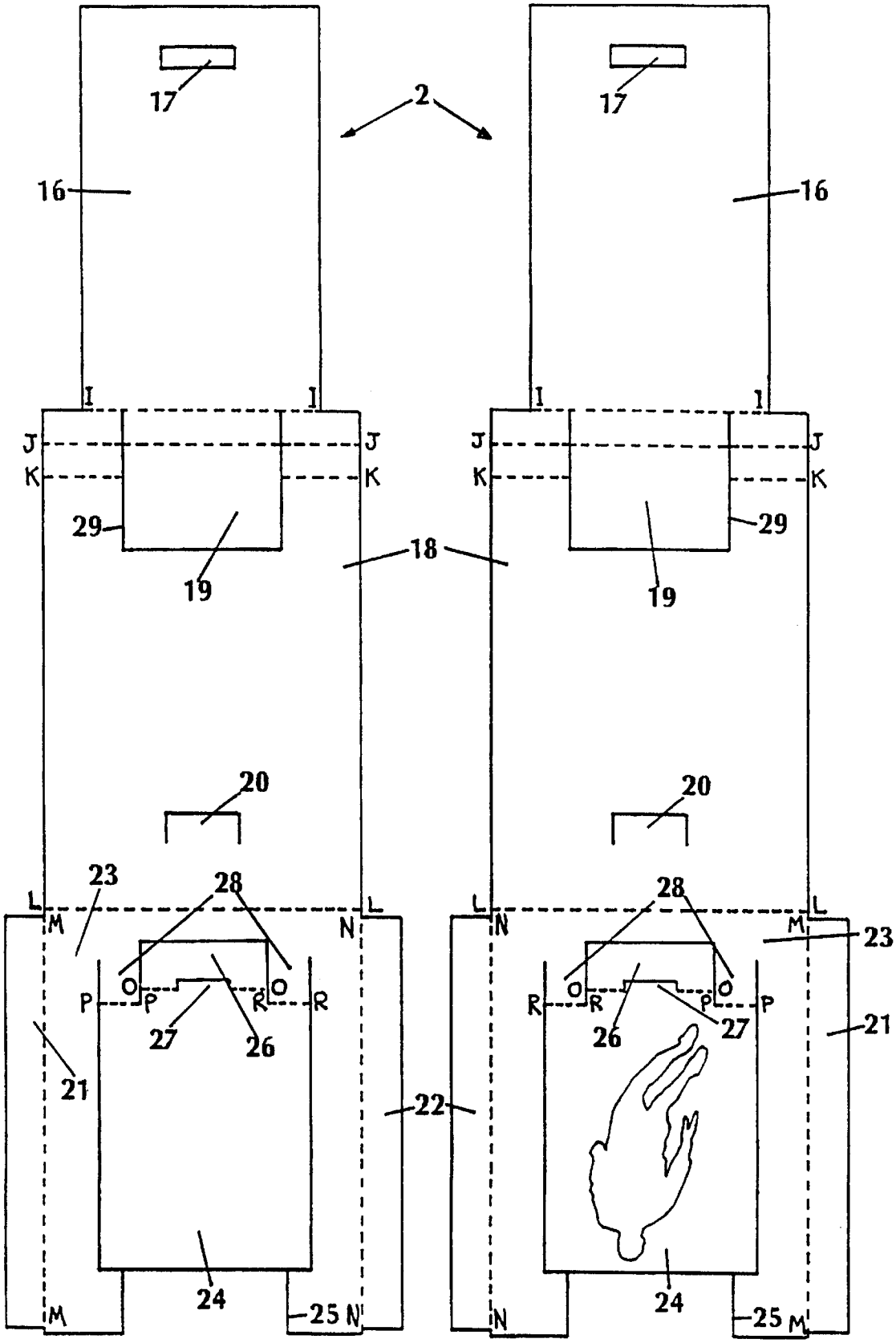
Figures 36, 37:
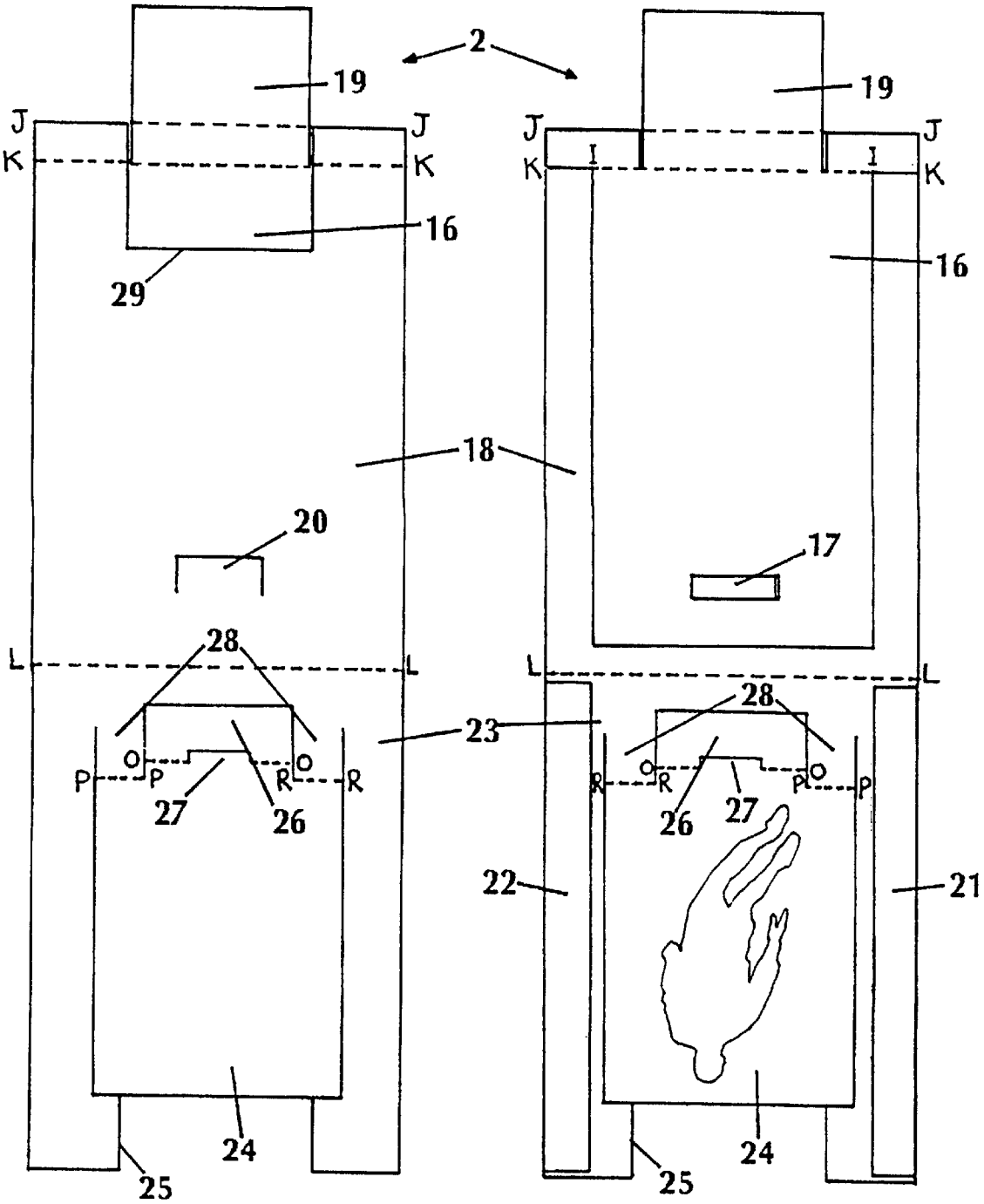
Figure 38:
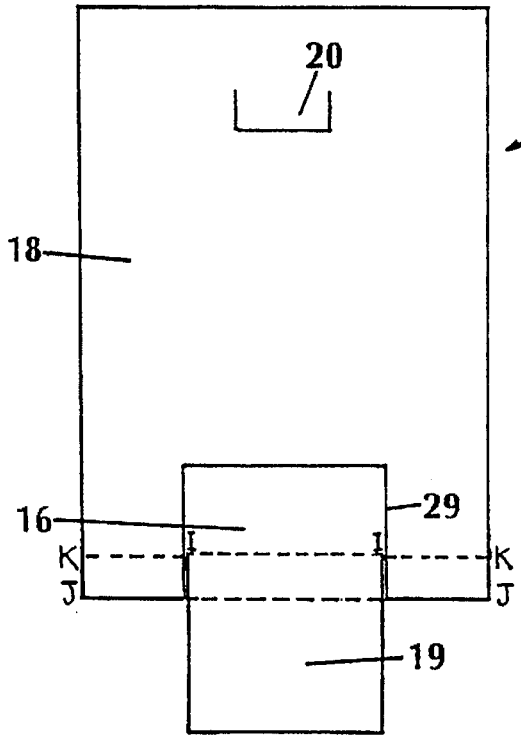
Figure 39:
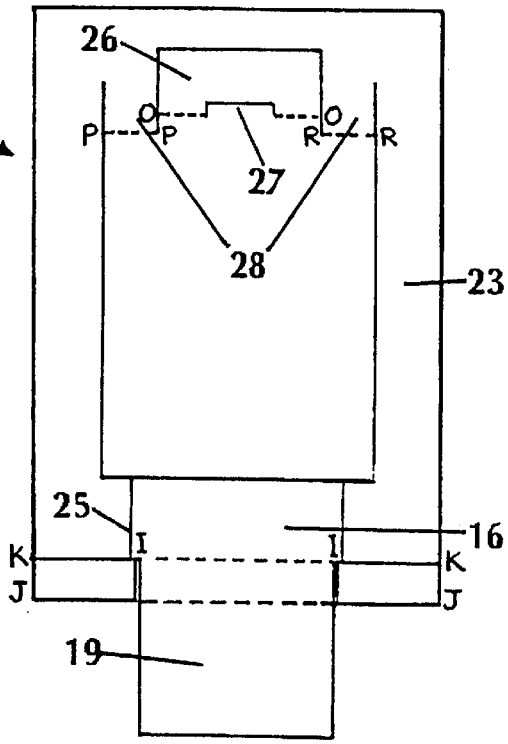
Figure 40:
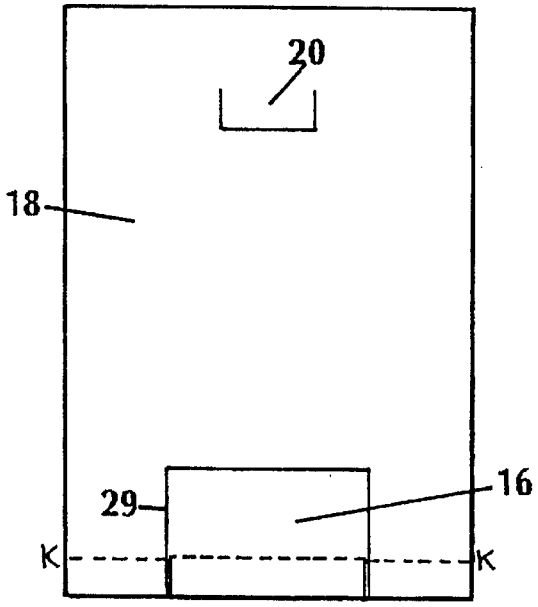

FIG. 34 is a front, or 'external' view of the apparatus prior to assembly;

FIG. 35 is a rear or 'internal' view of the same;

FIG. 36 is a front view showing the interior 'sliding' card folded down against the inside of the base panel;

FIG. 37 shows the internal view of the same;

FIG. 38 shows the rear of the assembled apparatus with the extension tab still unfolded;

FIG. 39 shows the front of the same stage;

FIG. 40 shows the fully assembled apparatus, but with the base-strip still attached.

Figure 41:
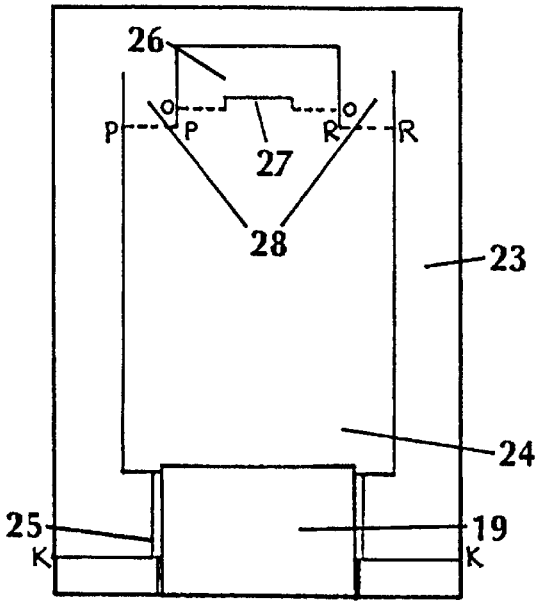
Figure 42:
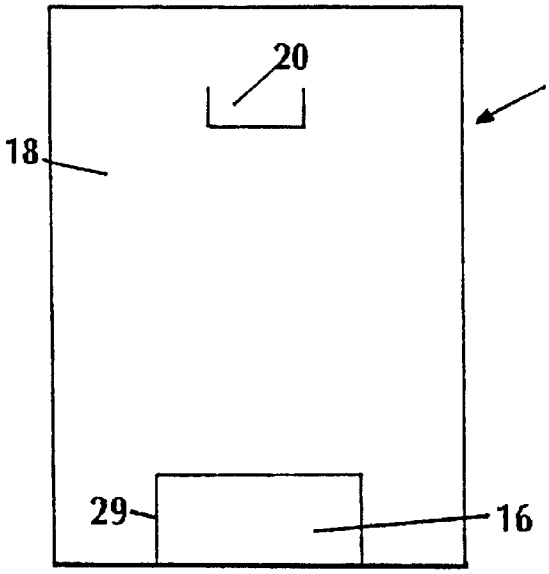
Figure 43:
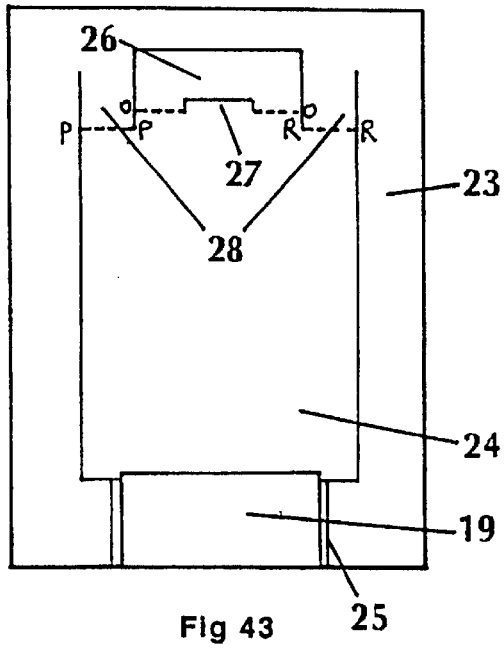
Figure 44:
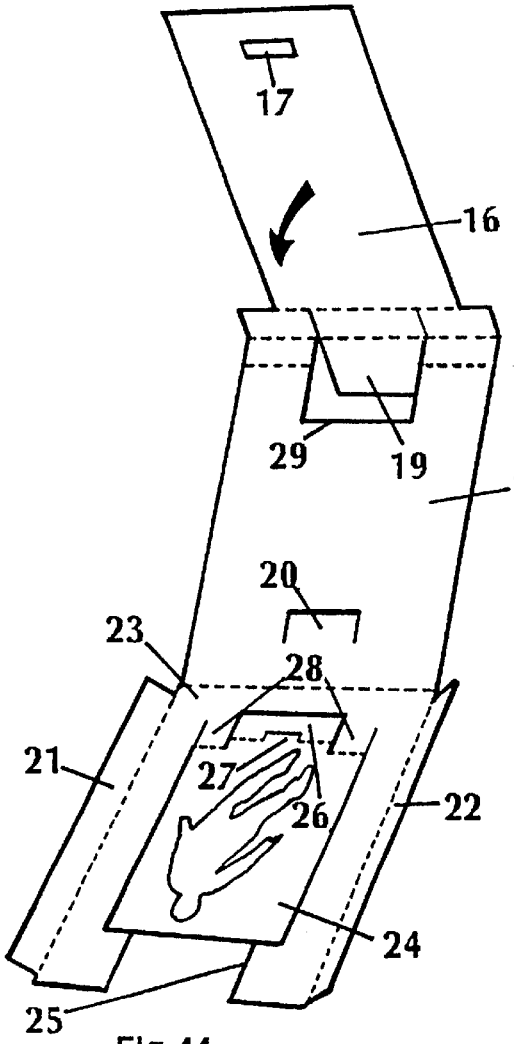
Figure 45:
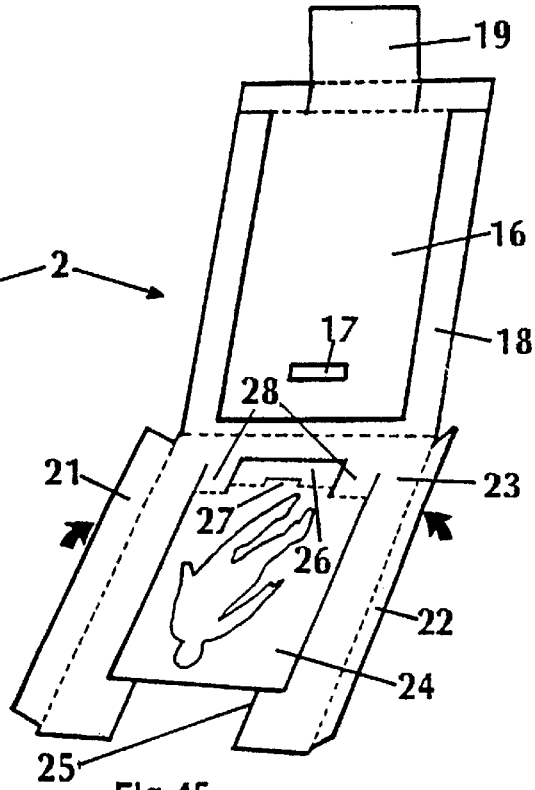
Figure 46:
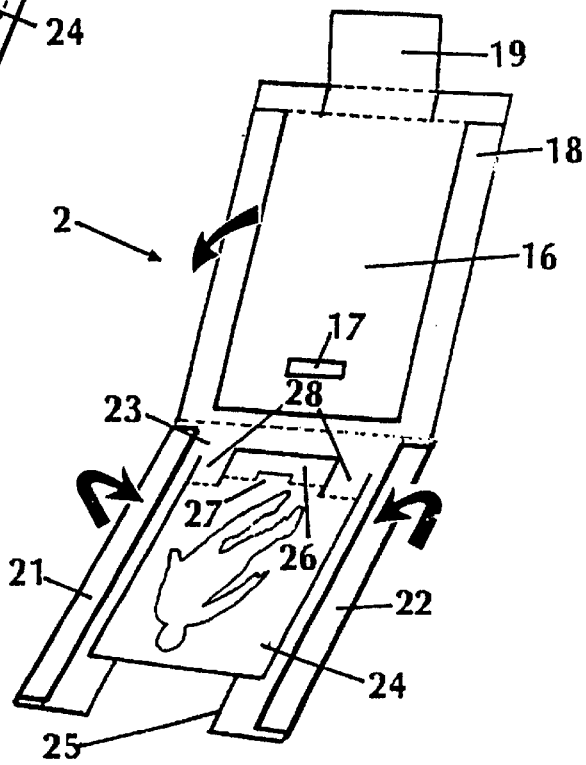
Figure 47:
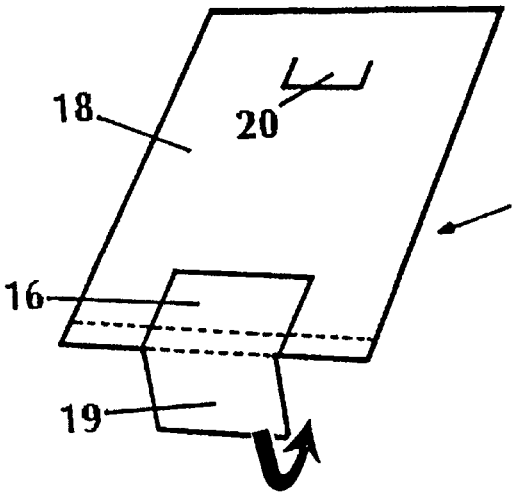
Figure 48:
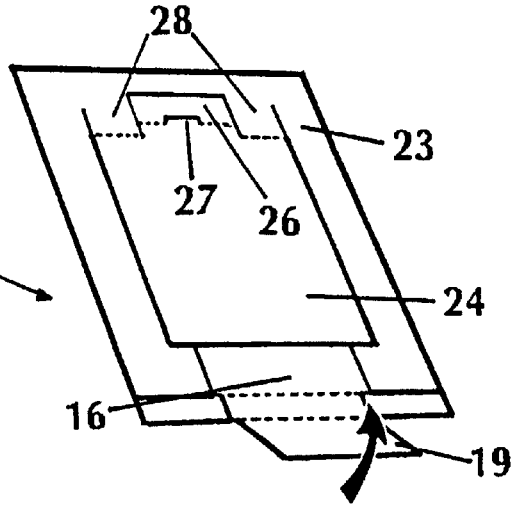
Figure 49:
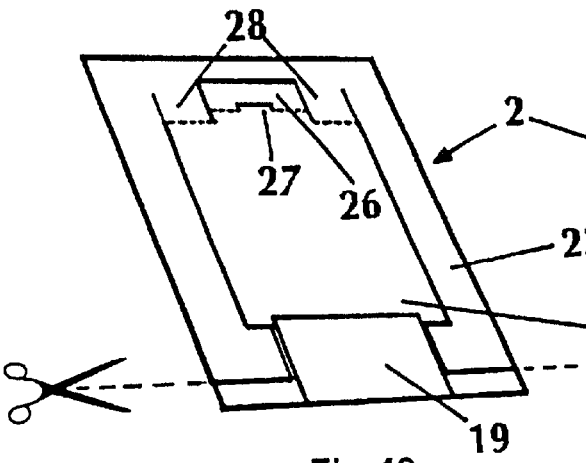
Figure 50:
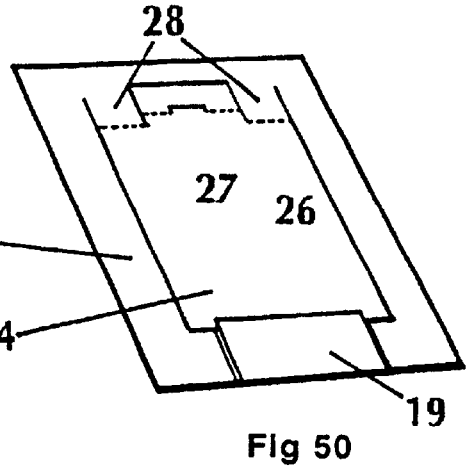
Figure 51:
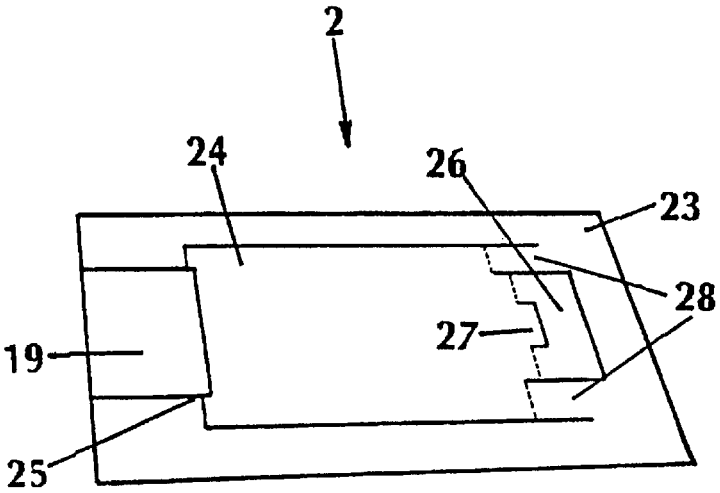
Figure 52:
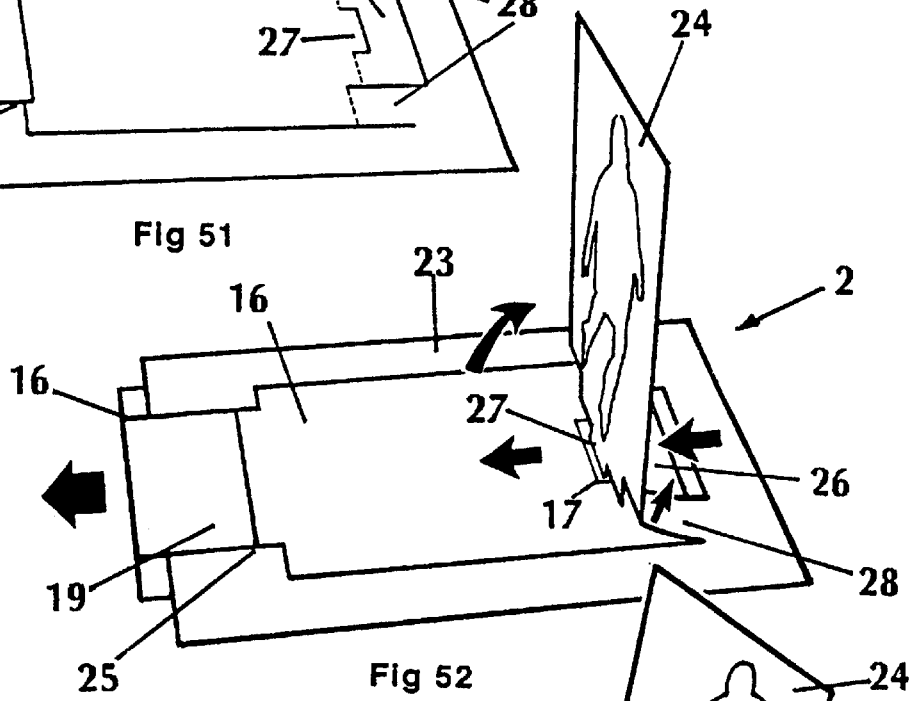
Figure 53:
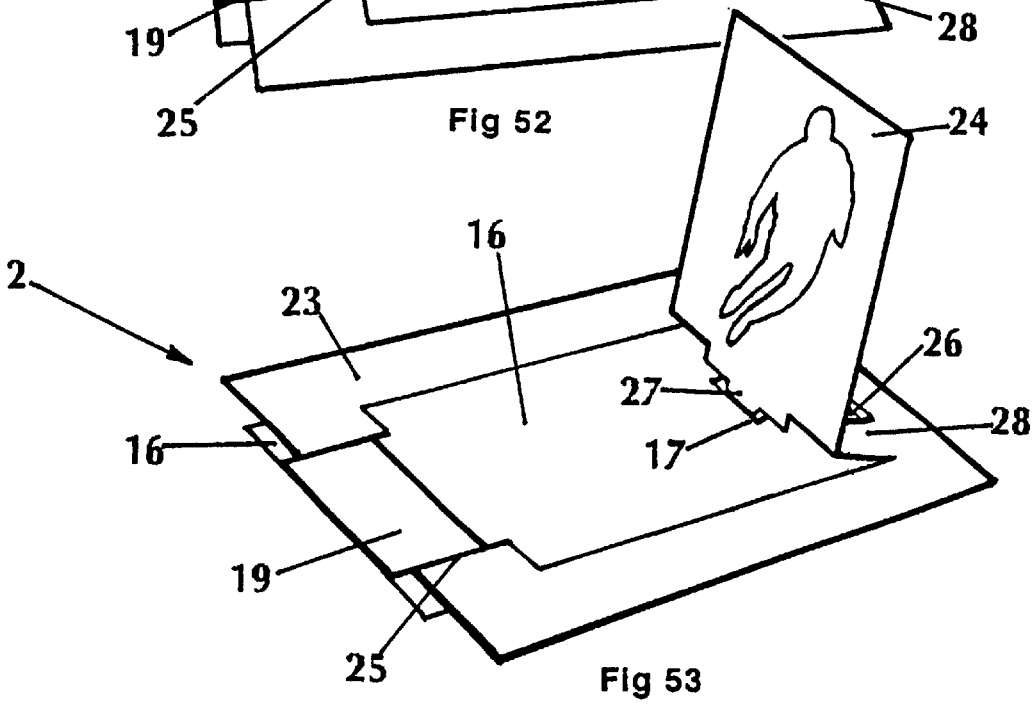

FIG. 41 shows the front of the same;

FIG. 42 shows the fully assembled apparatus from the back;

FIG. 43 shows the front view of the fully assembled apparatus;

FIGS. 44–50 show the assembly procedure in three dimensions;

FIGS. 51–53 show how the apparatus is deployed (same way as FIRST version: see schematic drawings in FIGS. 26–31).

According to FIGS. 34 and 35 the apparatus 2 consists of a single sheet of paper, card, plastic or some other suitable material. The apparatus 2 is in this case, rectangular, with a panel 24, which may carry an image or graphic on either of it's surfaces, cut out from the top surface 23, on three sides but joined on one edge by two 'arms' 28 which continue outwards from the panel 24, from fold lines P—P and R—R, stopping short of fold line L—L. Between the two arms 28, is a panel 26, wider than either of the two arms 28. This panel is also attached to the image panel 24, at a fold line O—O. This fold line O—O, however, although parallel with the other two fold lines P—P and R—R, is set a short distance further out towards the edge, fold line L—L, and is interrupted by a small projection or 'spur' 27, on the same plane as the image panel 24, extending into the centre panel 26. This centre panel 26 does not reach the edge of the top surface 23, but is stopped short by being cut across between the internal boundaries of the attaching arms 28. At the opposite edge of the front surface 2, a recess 25 which extends from the end of the panel 24, (the opposite end from the arms 28 and panel 26) to the open, far edge of the envelope 18, 23.

FIG. 34 shows the rear or exterior view of the apparatus 2 prior to assembly, and FIG. 35 shows the inside of the same. In FIG. 36 the interior sliding card 16 is shown folded down along fold line J—J, into the back or base surface 18 of the apparatus 2, creating an aperture 29 at one end of the base surface 18, as the extension tab 19 rotates outwards along fold line J—J. FIG. 37 shows the aperture 17 in position against the base or back panel 18, where it coincides with the slit or aperture 20. FIG. 36 also shows the side flaps 21, 22 folded inwards across surface 23 and FIG. 37 shows the obverse with the flaps 21, 22 glued in situ inside the front panel 23. FIGS. 38 and 39 show the back or base surface 18 of the now completed envelope 23, 18 with the extension tab 19 projecting outwards from interior sliding member 16, which is clearly visible through the recess 29 on the base surface 18, and the recess 25 on the top surface 23. The inside edges of the flaps 21,22 will act as guide 'rails' for the sliding panel 16 as it moves within the envelope 18, 23. The panel 26 is glued to the sliding card 16 which lies directly beneath it. The spur 27 which projects outwards into panel 26 along the same plane as the image panel 24, is now aligned with the aperture 17 on the sliding panel 16, which in turn is aligned with the slit 20 on the base panel 18. FIGS. 40 and 41 show the complete apparatus 2, with the extension tab 19 folded upwards into the body of the apparatus 2 and glued down onto the surface of the sliding card 16, where it forms a lip at it's top edge which projects slightly over the front edge of the image panel 24, and acts as a retainer member. At this stage, the sliding panel 16 cannot move within the envelope 18, 23, as it is still fixed to the base surface 18 by means of the strip between fold lines I—I and K—K, folded along J—J. In FIGS. 42 and 43, therefore the completed apparatus 2 is shown minus that strip I—I to K—K, which is simply cut off by a trimming operation at that stage.

The sliding card 16 is now free to move within the envelope 18, 23 backwards and forwards in one plane, ie, away from the panel 26 and towards the image panel 24. During deployment of the apparatus 2, when the extension tab 19 is pulled outwards from the body of the apparatus 2, it takes with it the panel 26, which has been glued to it. As the pressure of pulling builds, the image panel 24 rotates upwards about hinges P—P and R—R as the panel 26 moves forward on fold line O—O. At the same time, the spur 27 in the centre of fold line O—O dips downwards on the same plane as the image panel 24, which is rising at it's other end, being now released by the retaining lip at the leading edge of extension tab 19. As the spur 27 dips, it progresses through the aperture 17 on the sliding card 16, and encounters the slit 20 cut into the base 18, which impedes it's progress in a radius round the fulcrums on fold lines P—P and R—R, at the vertical to the plane of the apparatus 2, or at any angle set by the position of the impediment slit 20 on the base 18.

FIGS. 44–50 show the assembly operation in three dimensions.

FIG. 51 shows the apparatus 2 as the user would receive it: FIGS. 52 and 53 show the apparatus 2 in the deployed position.

The schematic drawings in FIGS. 26–31 showing how the apparatus 1 is deployed by the user, apply exactly to the deployment of apparatus 2. Furthermore, the variant described for application to apparatus 1, in FIGS. 32 and 33 is applicable to apparatus 2. The embodiments described here, are rectangular, but it will be appreciated that these can be made in a variety of shapes and sizes.

What is claimed is:

1. A graphic display device comprising an envelope (18, 23) and a display panel (24) attached to the envelope by two arms (28) a opposite sides of the display panel (24), said display panel and arms being cut from a top surface (23) of the envelope; an internal sliding member (16) being slidable in the envelope (18, 23) and attached top an extension portion (26) of the display panel (24) extending from a fold (0—0) at a base of the display panel between said arms (28), such that when a tab (19) at an end of the sliding member (16) remote from said extension portion is pulled, the display panel (24) is rotated about a fulcrum formed by fold lines (R—R, P—P) running transversely in the arms (28) from a first position in which the display panel (24) is flush with base section (18) of the envelope to a second position in which the display panel (24) is at i angle to the base section (18).

2. A graphic display device according to claim 1, wherein graphics or images are located both on a surface of the display panel (24) facing the sliding member (16) in the first position, and a surface of the sliding member (16) facing the display panel (24), said graphics or images being concealed in the first position and displayed in the second position.

3. A graphic display device according to claim 2, wherein the display panel (24) is locked in the second position by means of a projection (27) extending from the base of the display panel (24), which projection engages with an aperture (2) in the base section (18) of the envelope.

4. A graphic display device according to claim 3, including guides (21, 22) serving to confine the sliding member (16) on either side as the sliding member moves lengthways within the envelope (18, 23).

5. A graphic display device according to claim 3, wherein in a deployed position, the display panel (24), has continued it's movement past a position perpendicular to the envelope (18, 23) and lies flat against the envelope (18, 23).

6. A graphic display device according to claim 1, wherein the angle is a right angle.

7. A graphic display device according to claim 1, wherein both surfaces of the display panel (24) bear images or information.

8. A graphic display device comprising an envelope (3, 8), and a display panel (11), an interior sliding member (12) within the envelope being attached to the display pane (11) at a position which in use is below a fulcrum of the display panel (11) formed by an edge (E—E) of an interior fixed member (10) fixed within the envelope, the display panel (11) extending, in a position prior to deployment, on the same plane as the envelope (3, 8) within an aperture (9) in the envelope which aperture is marginally larger than the display panel (11) in which position an image or graphic on the side of the display panel (11) facing the envelope, is hidden, the sliding member (12) being arranged to lever the display panel (11) upright by rotating a shorter end of the display panel (11) extending beyond the edge (E—E) forming the fulcrum and thereby raising a longer, outside part of the panel (11) into an upright position.

9. A graphic display device according to claim 8, wherein the interior sliding member (12) has tab (13) on its end remote from the display panel (11), which tab can be pulled to deploy the display panel (11) into the upright position.

10. A graphic display device according to claim 9 wherein the interior sliding member (12) is movable in two opposite longitudinal directions within the envelope (3, 8) and is confined on two sides by guides (6, 7).

11. A graphic display device according to claim 10 wherein the display panel (11) is movable to the upright position by a single movement comprising either pulling said tab (13) or pushing the interior sliding member (12) inwardly of the envelope through an indented aperture cut into the envelope through an indented aperture cut into the envelope (3, 8) at am end thereof remote from the tab (13).

12. A graphic display device according to claim 11, wherein the envelope (3, 8) has a bottom panel (3) and the display panel (11) has a projection (27) at its base which in the upright position of the display panel (11) engages with an aperture (4) cut into the bottom panel (3) of the envelope, (3, 8).

13. A graphic display device according to claim 12 wherein the position of the aperture (4) in the bottom panel (3) determines the angle between the display panel (11) and the envelope (3, 8) in the upright position.

14. A graphic display device according to claim 13, wherein in the upright position, the display panel (11) is perpendicular to the envelope (3, 8).

15. A graphic display device according to claim 13, wherein in the upright position, the display panel (11) has continued its movement past a position perpendicular to the envelope (3, 8), and lies flat against the envelope (3, 8).

* * * * *